United States Patent [19]

Yurtin

[11] 3,977,757

[45] Aug. 31, 1976

[54] WIPE-IN FEMALE TERMINAL FOR PRINTED CIRCUITS

[75] Inventor: John A. Yurtin, Warren, Ohio

[73] Assignee: General Motors Corporation, Detroit, Mich.

[22] Filed: Mar. 17, 1975

[21] Appl. No.: 559,030

[52] U.S. Cl. ..... 339/217 S; 339/258 R

[51] Int. Cl.[2] ..... H01R 9/08

[58] Field of Search ..... 339/217 R, 217 S, 17 R, 339/17 C, 17 F, 220 R, 176 MF, 191 R, 191 L, 191 M, 191 S, 192 R, 192 T, 258 R, 258 P

[56] References Cited

UNITED STATES PATENTS

| | | | |
|---|---|---|---|
| 3,146,051 | 8/1964 | Woofter et al. | 339/47 R |
| 3,210,532 | 10/1965 | Woofter et al. | 339/176 L |
| 3,344,388 | 9/1967 | Parker et al. | 339/217 S |
| 3,613,043 | 10/1971 | Scheller et al. | 339/220 R |

FOREIGN PATENTS OR APPLICATIONS

| | | | |
|---|---|---|---|
| 657,838 | 9/1951 | United Kingdom | 339/217 S |

*Primary Examiner*—Roy Lake
*Assistant Examiner*—James W. Davie
*Attorney, Agent, or Firm*—F. J. Fodale

[57] ABSTRACT

A printed circuit assembly has a flexible printed circuit carried on a rigid panel which includes an open ended cavity. A flexible conductor strip of the printed circuit is wiped into the cavity by a sheet metal female terminal upon insertion of the terminal into one end of the cavity. The terminal has a box-like portion for receiving a male terminal inserted into the opposite end of the cavity, a first resilient tongue for biasing a terminal received in the box-like portion against an interior surface thereof and a pair of resilient tongues for biasingly engaging the conductor strip wiped into the cavity. The terminal also includes a transverse portion which biases the conductor strip against the panel outside of the cavity. Flat or partispherical dimples for contacting the conductor strip may be utilized and the terminal may include a ferrule portion.

8 Claims, 9 Drawing Figures

WIPE-IN FEMALE TERMINAL FOR PRINTED CIRCUITS

This invention relates generally to electrical terminals of unitary sheet metal construction and more particularly to a female terminal for a printed circuit.

It is already known from the U.S. Pat. No. 3,365,694 issued to George W. Parker on Jan. 23, 1968 for a "Connector Means" to provide unitary sheet metal terminals for a printed circuit having resilient tongues which, when the terminals are inserted into a cavity of a rigid panel carrying a printed circuit, wipe flexible conductor strips overhanging the cavity into the cavity to establish electrical connection between the terminals and the printed circuit. The terminals, however, have no provision for receiving a male terminal by means of which exterior electrical components may be plugged into the printed circuit.

Also it is already known from the U.S. Pat. No. 3,146,051 issued to Robert C. Woofter and Donald G. Baer on Aug. 25, 1964 for a "Terminal and Mounting Means" to provide a unitary sheet metal female terminal having a box-like portion intermediate its ends for receiving a male terminal and a resilient tongue connected to a forward protruding end of the terminal and partially disposed in the box-like portion for biasing a male terminal received in the box-like portion against an interior surface of the box-like portion. This female terminal, however, has no provisions for establishing an electrical connection with a printed circuit.

An object of this invention is to provide a female electrical terminal of unitary sheet metal construction having a box-like portion for receiving a male terminal and a resilient tongue at least partially disposed in the box-like portion for biasing a male terminal received in the box-like portion against an interior surface thereof, and at least another resilient tongue for wiping an overhanging flexible conductor strip of a printed circuit into a cavity of a rigid panel carrying the printed circuit when the terminal is inserted into the cavity.

Another object of this invention is to provide a female electrical terminal of unitary sheet metal construction adapted for insertion into an open-ended cavity of a rigid panel and having a box-like portion for receiving a male terminal and inserted into the cavity, a resilient tongue at least partially disposed in the box-like portion for biasing a male terminal received in the box-like portion against an interior surface thereof, and at least another resilient tongue for wiping an overhanging flexible conductor strip of a printed circuit carried by the rigid panel into the cavity when the terminal is inserted into the cavity and biasingly engaging the wiped-in flexible conductor strip to establish electrical contact with the printed circuit.

Still another object of this invention is to provide a female electrical terminal in accordance with either of the preceding objects which is of compact design in the longitudinal direction and which may have one or more of the following features: a stiff latch edge for cooperation with a terminal receiving cavity to prevent pull out, separate tongues connected to forward portions of the terminal and inclined in the same direction for engaging a male terminal and a flexible conductor strip respectively thus adapting the female terminal for insertion into one end of a cavity and for receiving a male terminal inserted into the opposite end of the cavity, a transverse, outwardly extending portion for engaging a surface or a surface of the flexible conductor strip transverse to a cavity receiving the terminal, two separate tongues for engaging the flexible conductor strip, portions for establishing electrical connection with a flexible conductor strip at two, three or four spaced locations, and dimples for contacting the flexible conductor strip.

The exact nature of this invention as well as other objects and advantges thereof will be readily apparent from consideration of the following specification relating to the annexed drawing in which.

Figure 1:
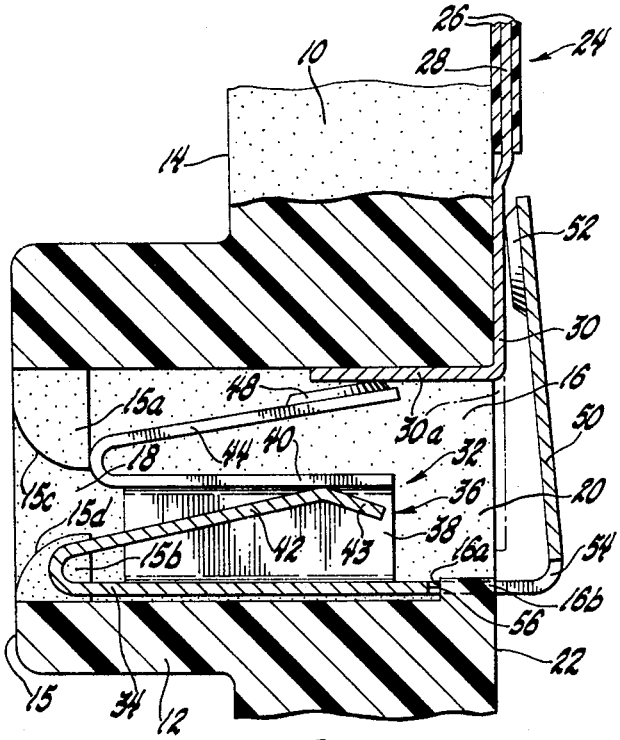
FIG. 1 is a section through a printed circuit assembly utilizing a wipe-in female terminal in accordance with this invention.

Referring now to the drawing and more particularly to FIG. 1, a printed circuit assembly comprising a rigid panel 10 having a boss 12 protruding from the rear surface 14 is shown. An open-ended, generally rectangular cavity 16 extends through the rigid panel 10 from a restricted opening 18 in the rear surface 15 of the boss 12 to an unrestricted opening 20 at the front surface 22 of the panel. The assembly further includes a flexible printed circuit 24 comprising two thin sheets 26 of a generally flexible material, such as a polyester of a few thousandths thickness, bonded together with an interposed flat sheet 28 of copper or other suitable conducting material having any desired circuit pattern, but which includes at least one exposed flexible conductor strip 30 for making an electrical connection with a terminal. The flexible printed circuit 24 is carried on the front surface 22 of the rigid panel 10 with the end portion **30*a* of the exposed conductor strip disposed in the cavity 16 and biasingly engaged therein by a female terminal 32.**

The female terminal 32 disposed in the cavity 16 has portions adapted to receive a male terminal, such as the male blade terminal, shown in phantom in FIG. 1, into the cavity through the restricted opening 18. The terminal 32 is insertable into the cavity through the unrestricted opening 20 at the front of the panel and has portions for wiping the end portion **30*a* of the conductor strip 30 (originally overhanging the cavity as shown by the phantom line position) into the cavity when the terminal is inserted into the cavity through the opening 20 and biasingly engaging the "wiped-in" end portion 30*a*. In its assembled position, the terminal 32 also has portions outside of the cavity which contact the conductor strip 30 at locations spaced from the edge 20*a* of the opening 20 over which the conductor strip 30** is wiped-in.

Figure 3:
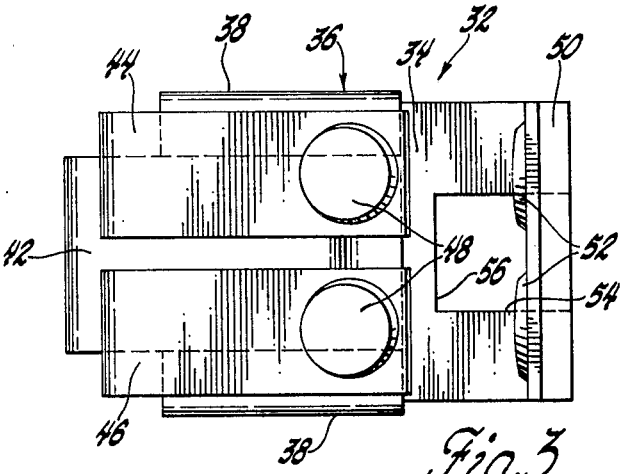
FIGS. 3, 4 and 5 are top, front and perspective views respectively of the wipe-in female terminal shown in FIGS. 1 and 2.
Figure 4:
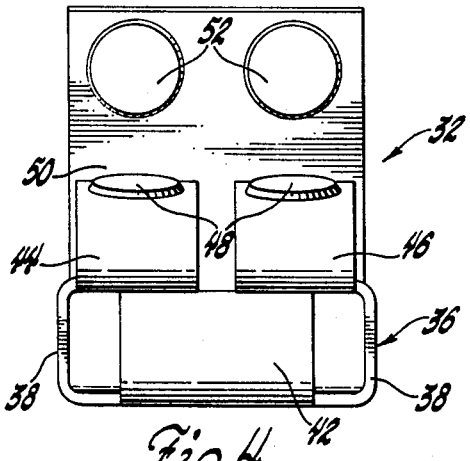
Figure 5:
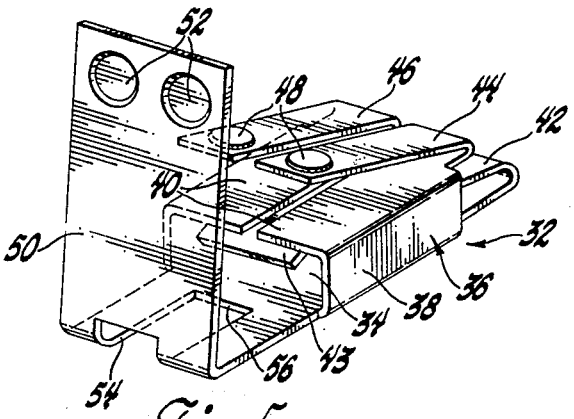

More specifically and referring also to FIGS. 3, 4 and 5, the female terminal 32 which is of unitary sheet metal construction comprises a generally planar body portion 34 having an intermediate box-like portion 36.

The box-like portion 36 includes side walls 38 contiguous respectively with laterally spaced sides of the body portion 34 which side walls 38 have inturned lateral flanges 40 at their free ends. The inturned lateral flanges 40 are substantially coplanar and may have a spacing therebetween. A first resilient inclined tongue 42 is connected to the forward end of body portion 34 by a reverse bend from whence the tongue 42 extends upwardly and rearwardly into the interior of the box-like portion 36 where it terminates in a downwardly bent lip portion 43. Thus the tongue 42 is adapted to bias a male terminal received in the box-like portion 36 into engagement with the interior surfaces of the inturned flanges 40. Second and third identical resilient inclined tongues 44 and 46 are respectively connected to the forward end of the inturned flanges 40 by reverse bends from which these tongues extend rearwardly and upwardly. The tongues 44 and 46 disposed outwardly of the box-like portion 36 preferably have raised areas, such as the outwardly projecting flat dimples 48, adjacent their free ends for establishing electrical contact with the end portion 30*a* of the conductor strip which is wiped into the cavity 16.

The female terminal 32 further includes a transverse portion 50 connected to the rearward end of the body portion 34. The transverse portion 50 extends outwardly of the resilient tongues 44 and 46 and also preferably has a pair of spaced raised areas, such as the forwardly projecting flat dimples 52, for establishing electrical contact with the conductor strip 30 at locations spaced from the edge 20*a* of the opening 20 into the cavity 16. A longitudinal slot 54 in the body portion 34 extends from the rearward end of the body portion (and through the transverse portion 50) forwardly terminating at a rearwardly facing latch edge 56.

Figure 2:
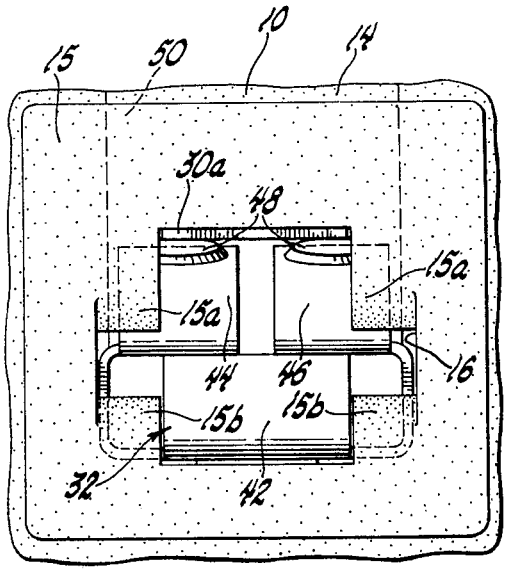
FIG. 2 is a front view of the printed circuit assembly shown in FIG. 1.

Focussing now on FIGS. 1 and 2, the female terminal 32 is attached to the rigid panel 10 by inserting the female terminal 32 forward end first into the cavity 16 through the opening 20 at the front surface of the panel. During insertion the tongues 44 and 46 contact the end portion 30*a* of the strip 30 and wipe it into the cavity 16. Over-insertion of the terminal 32 is prevented by the front ends of the tonges 44 and 46 engaging upper corner abutments 15*a* depending from the boss 15 at the opening 18. The boss 15 also has lower corner abutments 15*b* at the opening 18 which laterally position the forward end of the terminal in cooperation with the forward end of the body portion 34. Curved surfaces 15*c* and 15*d* are provided on the abutments 15*a* and 15*b* respectively for guiding a male terminal into the box-like portion of the female terminal 32. The terminal 32 is retained in the cavity 16 by the latch edge 56 engaging a cooperating latch shoulder 16*a* of a central protrusion 16*b* in the cavity 16 which fits into the slot 54. Due to the resilience of the tongues 44 and 46, the body portion 34 is able to ride over the central protrusion 16*b* during insertion thus permitting the use of relatively stiff latch edge 56 connected at its lateral ends to the body portion 34 in place of the more conventional spring finger.

In the assembled position, the transverse portion 50 of the terminal 32 is biased into engagement with the conductor strip 30 at a location spaced from the opening 20 thus providing additional electrical contact; the electrical contact preferably being established by forwardly projecting dimples 52. These additional electrical contacts improve the electrical connection to the printed circuit and thus may be use for heavy current applications on the order of 20.0 amps.

Figure 6:
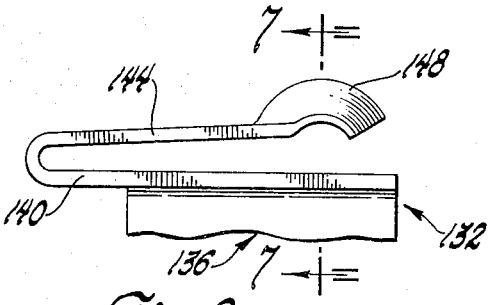
FIG. 6 is a fragmentary side view of a modified wipe-in female terminal similar to that shown in FIGS. 1–5.
Figure 7:
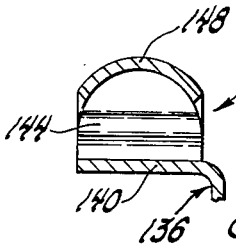
FIG. 7 is a section taken along the line 7—7 of FIG. 6 and looking in the direction of the arrows.

Referring now to FIGS. 6 and 7, a fragmentary view of a wipe-in female terminal having modified tongues is illustrated. More particularly, a typical modified tongue 144 for wiping the end portion of a conductor strip into a cavity is connected to the forward end of an inturned flange 140 of a box-like portion 136 of the terminal 132 from whence it extends rearwardly and upwardly. The raised contact area adjacent the free end of the modified tongue 144 is an outwardly projecting partispherical dimple 148 adapted to establish point contact with the conductor strip. While the FIG. 6 embodiment shows only one typical tongue 144, it is to be understood another resilient tongue of the same configuration would be connected to the forward end of the other inturned flange.

Except for the modified tongues such as tongue 144 adapted to establish point contact with the conductor strip portion wiped into the cavity, the female terminal 132 is otherwise the same as the female 32. In applications where space permits, forwardly projecting partispherical dimples of the form shown in FIGS. 6 and 7 may be utilized adjacent the free end of the transverse portion of the terminal 32 in place of the flat dimples 52. Such dimples may also be used, space permitting, in the transverse portion (not shown) of the terminal 132.

Figure 8:
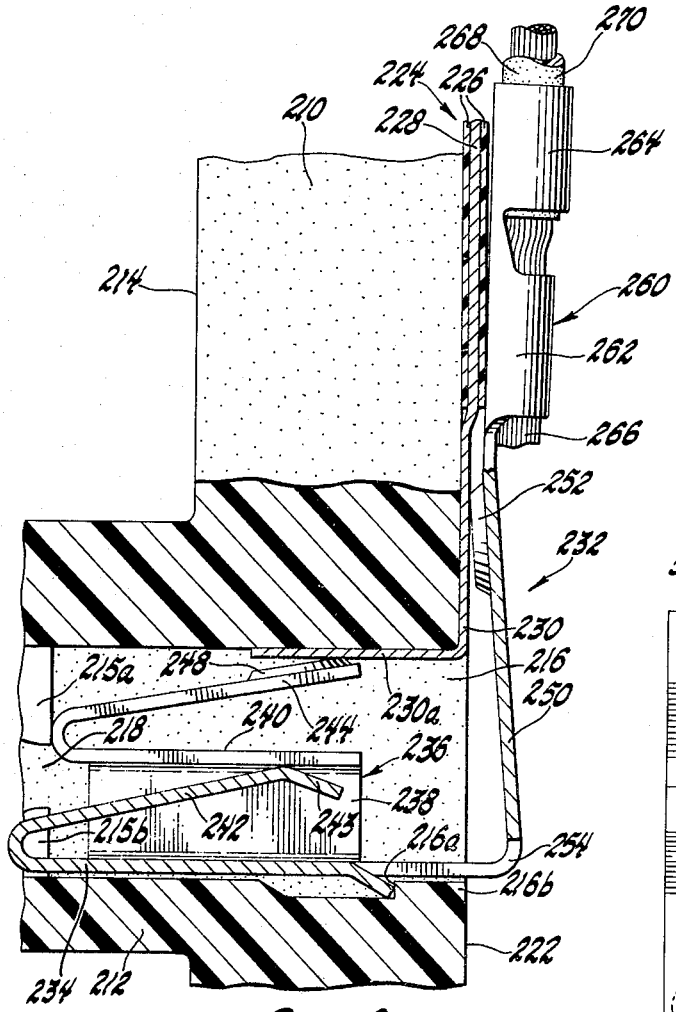
FIG. 8 is a section through a printed circuit assembly similar to FIG. 1 utilizing a wipe-in female terminal similar to that shown in FIGS. 1–5.

Referring now to FIG. 8, another modification of a female terminal in accordance with this invention is shown. More particularly, the female terminal 232 includes a ferrule portion 260 for connecting a lead wire to the printed circuit as well as connecting other electrical devices to the printed circuit by way of a male terminal received in the female terminal. Other than this added feature, the terminal 232 is identical to that shown in FIGS. 1–5 with the corresponding portions identified by adding 200 to the identifying numerals in FIGS. 1–5. The added ferrule portion 260 is contiguous with the outward end of the transverse portion 250 of the terminal 232. This ferrule portion comprises conventionally spaced pairs of wings 262 and 264 which are respectively crimped around the exposed conductor end 266 and insulator 268 of a lead wire 270 in conventional manner. Of course other types of ferrule portions may be utilized.

Figure 9:
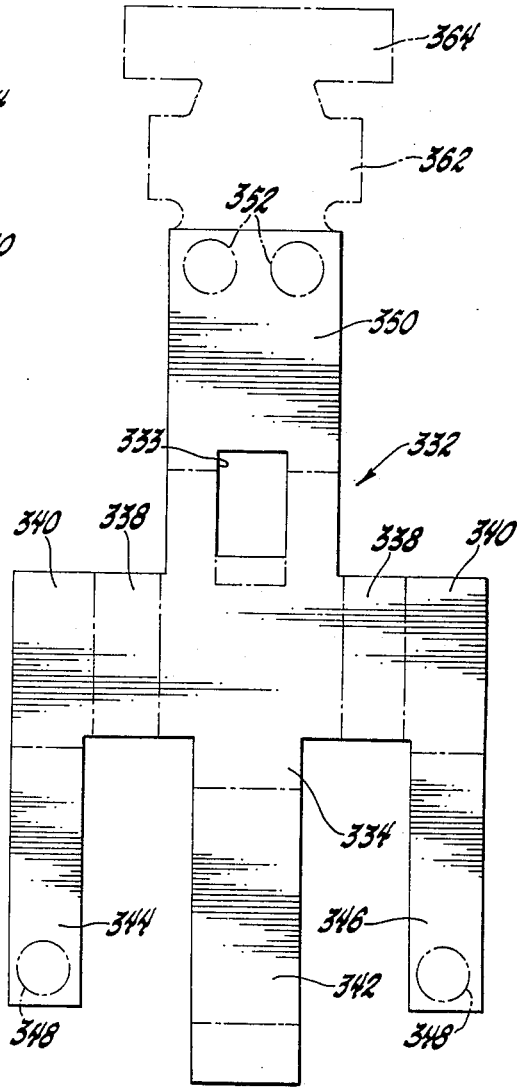
FIG. 9 is a plan view of a stamped sheet metal blank from which the terminals shown in FIGS. 1–8 may be constructed.

Referring now to FIG. 9, there is shown a typical stamped sheet metal blank 332 for forming the female terminal 32 shown in FIGS. 1–5. The blank 332 is fork-shaped with a central rectangularly-shaped hole 333 and is illustrated with dashed bend lines along which the blank is bent to form the terminal in a manner and sequence which will be obvious to those skilled in the art from the following correlation between the blank portions and the terminal portions. The portion 334 of the central tine corresponds to the body portion 34 of the terminal 32 while the portion 342 corresponds to the first tongue portion 42. The handle portion 350 corresponds to the transverse portion 50 of the terminal while the portions 338 between the tines correspond to side walls 38. The portions 340 of the outer tines provide the inturned flanges 40 contiguous with the side walls and the end portions 344 and 346 of the tines provide the tongues 44 and 46 respectively. Either flat or partispherical dimples may be provided as desired and a ferrule portion may be provided by including an additional blank portion 364 shown in phantom.

Thus it can be seen that this invention provides a compact female electrical terminal of simple unitary sheet metal construction having a box-like portion for receiving a male terminal, a resilient tongue at least partially disposed in the box-like portion for biasing a male terminal received in the box-like portion against an interior wall thereof, and a second resilient tongue for wiping an overhanging flexible conductor strip of a printed circuit into a cavity upon insertion of the terminal into the cavity and which may further include a number of additional features.

I wish it to be understood that I do not desire to be limited to the exact details of construction shown and described, for obvious modifications will occur to a person skilled in the art.

I claim:

1. A female electrical terminal of unitary sheet metal construction comprising:

a generally planar body portion having a forward end and a rearward end, a box-like portion for receiving a male terminal, said box-like portion comprising side walls which are contiguous respectively with laterally spaced sides of the body portion and which have inturned lateral flanges at their free ends, a first resilient tongue at least partially disposed in said box-like portion for biasing a male terminal received in said box-like portion against an interior surface thereof, and a second resilient tongue having a forward inclined portion which is at least partially disposed outwardly of said box-like portion and which extends rearwardly and outwardly with respect to said body portion from a reverse bend portion located forward of said box-like portion whereby the female electrical terminal is adapted to make electrical connection with a printed circuit by wiping an overhanging flexible conductor strip of a printed circuit into a cavity of a rigid panel carrying the printed circuit when the terminal is inserted into the cavity.

2. A female electrical terminal of unitary sheet metal construction comprising:

a generally planar body portion having a forward end and a rearward end, a box-like portion for receiving a male terminal, said box-like portion comprising side walls which are contiguous respectively said laterally spaced sides of the body portion and which have inturned lateral flanges at their free ends, a first resilient inclined tongue connected to the forward end of the body portion at least partially disposed in said box-like portion beneath said inturned lateral flanges for biasing a male terminal received in said box-like portion against an interior surface of said inturned flanges, and a second resilient tongue connected to a forward end of one of said inturned lateral flanges having a forward inclined portion which extends rearwardly and outwardly with respect to said inturned flanges of said box-like portion whereby the female electrical terminal is adapted to make electrical connection with a printed circuit by wiping an overhanging flexible conductor strip of the printed circuit into an open ended cavity of a rigid panel carrying the printed circuit when the terminal is inserted into the cavity through a first open end and receive a male terminal in the box-like portion inserted into an opposite open end of the cavity when the terminal is disposed in the cavity.

3. The female terminal as defined in claim 2 further including a transverse portion connected to the body portion rearwardly of the box-like portion and extending in transverse direction from said body portion outwardly beyond said second resilient tongue whereby said transverse portion is adapted for overlapping portions of the rigid panel adjacent the cavity.

4. The female terminal as defined in claim 2 further including a ferrule portion disposed rearwardly of said box-like portion for connecting the terminal to a lead wire.

5. The female terminal as defined in claim 3 further including a ferrule portion connected to the free end of said transverse portion for connecting the terminal to a lead wire.

6. A female electrical terminal of unitary sheet metal construction comprising:

a generally planar body portion having a forward end and a rearward end, a box-like portion for receiving a male terminal, said box-like portion comprising side walls which are contiguous respectively with laterally spaced sides of the body portion and which have inturned lateral flanges at their free ends, a first resilient inclined tongue connected to the forward end of the body portion and extending rearwardly and upwardly therefrom and terminating in a downward lip disposed in said box-like portion beneath said inturned lateral flanges adapting said first resilient tongue for biasing a male terminal received in said box-like portion against an interior surface of said inturned flanges, second and third resilient inclined tongues connected respectively to forward ends of said inturned lateral flanges and extending rearwardly and upwardly therefrom whereby the female electrical terminal is adapted to make electrical connection with a printed circuit by wiping an overhanging flexible conductor strip of the printed circuit into an open ended cavity of a rapid panel carrying the printed circuit when the terminal is inserted into the cavity through a first open end and receive a male terminal in the box-like portion inserted into an opposite open end of the cavity when the terminal is disposed in the cavity, said second and third tongues each having an outwardly projecting dimple for contacting a flexible conductor strip wiped into a cavity, a transverse portion connected to the body portion at the rearward end thereof and extending outwardly of said second and third tongues, said transverse portion having forwardly projecting dimple means located outwardly of said second and third tongues whereby said transverse portion is adapted to engage a conductor strip disposed on a surface transverse to a cavity when the terminal is inserted into the cavity, and a rearwardly facing latch edge connected to said body portion forwardly of said transverse portion for retaining the terminal in a cavity.

7. A female electrical terminal of unitary sheet metal construction comprising:

a generally planar body portion having a forward end and a rearward end, a box-like portion for receiving a male terminal, said box-like portion comprising side walls which are contiguous respectively with laterally spaced sides of the body portion and which have inturned lateral flanges at their free ends, a first resilient inclined tongue connected to the forward end of the body portion at least partially disposed in said box-like portion beneath said inturned lateral flanges for biasing a male terminal received in said box-like portion against an interior surface of said inturned flanges, a second resilient inclined tongue connected to a forward end of one of said inturned lateral flanges and at least partially disposed adjacent and outwardly of said inturned flanges of said box-like portion whereby the female electrical terminal is adapted to make electrical connection with a printed circuit by wiping an overhanging flexible conductor strip of the printed circuit into an open ended cavity of a rigid panel carrying the printed circuit when the terminal is inserted into the cavity through a first open end and receive a male terminal in the box-like portion inserted into an opposite open end of the cavity when the terminal is disposed in the cavity, and a transverse portion connected to the body portion rearwardly of the box-like portion and extending outwardly of said second resilient tongue for overlapping portions of the rigid panel adjacent the cavity, said second tongue and said transverse portion each having a dimple for contacting the conductor strip at a plurality of spaced locations.

8. The female terminal as defined in claim 7 wherein said dimple of said second tongue is a raised outwardly projecting area adjacent a free end thereof and said dimple of said transverse portion is a raised forwardly projecting area spaced outwardly of said second tongue whereby the terminal is adapted to contact the conductor strip at a plurality of spaced locations and wherein said body portion has a rearwardly facing latch edge located forwardly of the transverse portion for retaining the terminal in the cavity with the transverse portion disposed outside of the cavity.

* * * * *